United States Patent [19]

Franke

[11] 4,446,569

[45] May 1, 1984

[54] X-RAY DIAGNOSTIC GENERATOR FOR AN X-RAY TUBE COMPRISING SEVERAL FOCAL SPOTS

[75] Inventor: Kurt Franke, Erlangen, Fed. Rep. of Germany

[73] Assignee: Siemens Aktiengesellschaft, Berlin & Munich, Fed. Rep. of Germany

[21] Appl. No.: 217,215

[22] Filed: Dec. 17, 1980

[30] Foreign Application Priority Data

Jan. 14, 1980 [DE] Fed. Rep. of Germany ..... 3001118

[51] Int. Cl.[3] ..... H05G 1/30

[52] U.S. Cl. ..... 378/115

[58] Field of Search ..... 378/105, 113, 114, 115, 378/134, 92; 315/98, 105, 106, 107, 334; 307/2, 27, 129; 333/132

[56] References Cited

U.S. PATENT DOCUMENTS

| | | | |
|---|---|---|---|
| 1,624,646 | 4/1927 | Wolfe | 333/132 |
| 2,044,047 | 6/1936 | Bobis | 333/132 |
| 2,931,908 | 4/1960 | Hardenberg | 378/92 |
| 3,087,440 | 4/1963 | Zarnstorff | 307/129 |
| 3,110,810 | 11/1963 | Fransen | 378/115 |
| 3,610,984 | 10/1971 | Seki et al. | 378/115 |

FOREIGN PATENT DOCUMENTS

| | | | |
|---|---|---|---|
| 2326341 | 12/1974 | Fed. Rep. of Germany | 378/115 |

*Primary Examiner*—Alfred E. Smith
*Assistant Examiner*—Jack I. Berman
*Attorney, Agent, or Firm*—Hill, Van Santen, Steadman & Simpson

[57] ABSTRACT

In an exemplary x-ray generator with several focal spots, a supply device for energizing the heating filaments for the respective focal spots comprises a single filament supply transformer for all heating filaments with which generator circuitry for supplying different frequencies is connected, and one filter each is connected between each heating filament and the secondary winding of the filament transformer. The pass bands of the filters correspond to the different generator frequencies.

1 Claim, 1 Drawing Figure

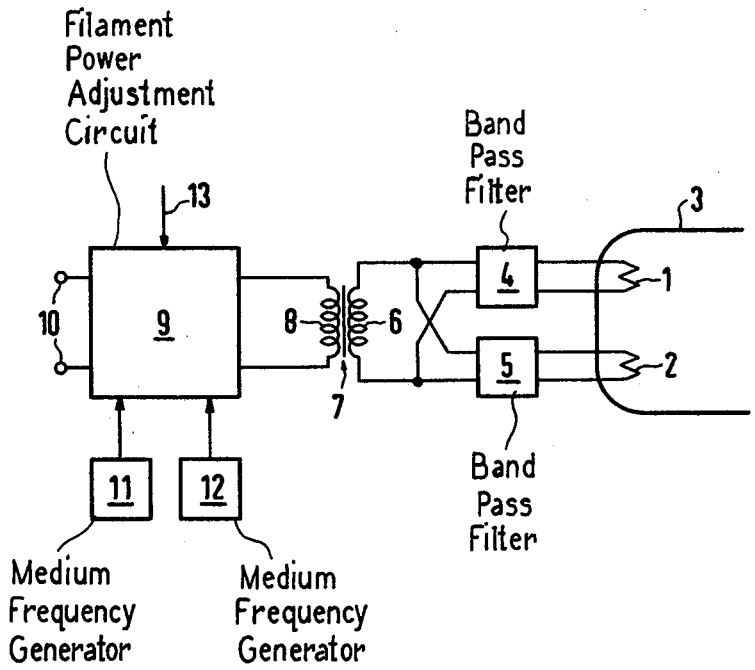
Filament
Power
Adjustment
Circuit
13
Band
Pass
Filter
3
10
9
8
6
4
1
5
2
7
11
12
Band
Pass
Filter
Medium
Frequency
Generator
Medium
Frequency
Generator

X-RAY DIAGNOSTIC GENERATOR FOR AN X-RAY TUBE COMPRISING SEVERAL FOCAL SPOTS

BACKGROUND OF THE INVENTION

The invention relates to an x-ray diagnostic generator for an x-ray tube comprising several focal spots and a heating filament for each focal spot, in which a supply device for the heating filaments is provided.

X-ray diagnostic generators of this type are known in which a filament supply transformer is provided for each heating filament. However, this signifies a comparatively great space requirement for accommodating the filament supply transformers. X-ray diagnostic generators are also known in which the feeding of the x-ray tube proceeds with a frequency in the kHz-range (medium frequency), so that the high voltage transformer can be designed to be comparatively small and lightweight. In the case of such an x-ray diagnostic generator the heating (or filament) voltage can also be a medium frequency a.c. voltage.

SUMMARY OF THE INVENTION

The object underlying the invention resides in designing an x-ray diagnostic generator of the type initially cited such that the space requirement for the supply device for the heating filaments can be kept small.

This object is achieved in accordance with the invention in that the supply device comprises a single filament supply transformer for all heating filaments, generator circuitry for supplying different frequencies connected with the primary side of the filament transformer, and respective filters connected between the secondary winding of the filament supply transformer and the respective heating filaments, the pass bands of the respective filters being transmissive of the respective generator frequencies. In the inventive x-ray diagnostic generator it is possible, through selection of the generator frequency to be supplied to the filament supply transformer, to determine which of the heating filaments is to be energized. The filament power can be individually adjusted for each focal spot.

The invention shall be explained in greater detail in the following on the basis of the exemplary embodiment illustrated in the accompanying drawing sheet; and other objects, features and advantages will be apparent from this detailed disclosure and from the appended claims.

BRIEF DESCRIPTION OF THE DRAWING

The single FIGURE is an electric circuit diagram illustrating an embodiment of the invention with two heating filaments.

DETAILED DESCRIPTION

In the drawing, the two heating filaments 1 and 2 of an x-ray tube 3 are illustrated which are associated with two different focuses of the x-ray tube. The heating filaments 1 and 2 are connected via two filters 4 and 5 to the secondary winding 6 of a filament supply transformer 7. The filter 4 is here, for example, transmissive for frequencies between 2 and 7 kHz, and the filter 5 is transmissive for frequencies between 8 and 12 kHz. The primary winding 8 of the filament supply transformer 7 is connected to an adjustment device 9 for the filament power which is connected to mains terminals 10 for supply with a.c. voltage at the commercial power frequency (e.g. 60 Hz), on the one hand, and to which a medium frequency is supplied selectively from two frequency generators 11 and 12. The frequency generator 11 delivers a frequency in the range between 2 and 7 kHz, and the frequency generator 12 delivers a frequency in the range between 8 and 12 kHz.

If the heating filament 1 is to be heated, the frequency generator 11 is switched on. The output voltage of the filament supply transformer is allowed to pass through by the filter 4 and is connected to the heating filament 1, while filter 5 effectively blocks transmission of the frequency. Correspondingly, the heating filament 2 can be heated by switching on the frequency generator 12. The filament power, and hence the x-ray tube current, are determined, respectively, by the adjustment device 9 which receives an adjustment signal at the input 13.

It will be apparent that many modifications and variations may be effected without departing from the scope of the novel concepts and teachings of the present invention.

SUPPLEMENTAL DISCUSSION

By way of example, generators 11 and 12 may be inverter circuits receiving direct current power via a rectifier and filter forming part of circuit 9. Generator 11 may supply a frequency of 4.5 kilohertz while generator 12 may provide a frequency of ten kilohertz, for example, so that the respective output frequencies of generators 11 and 12 are in the central part of the pass bands of filters 4 and 5, respectively, and are widely separated such that filter 5 effectively blocks transmission of the frequency of generator 11, and filter 4 effectively blocks transmission of the frequency of generator 12.

The adjustment circuit 9 may be of a conventional type used with a medium frequency filament circuit. Where a closed loop control circuit for sensing x-ray tube current is provided, the power supplied to primary winding 8 may be controlled by a common power amplifier circuit of component 9 havings its input connected with the outputs of both of the generators 11, 12, and having its amplification control input connected with input line 13, which may supply a signal in accordance with any departure of actual x-ray tube current from a setpoint value. Thus regardless of the generator frequency, the common power amplifier of component 9 will adjust the filament power so as to maintain the setpoint value of x-ray tube current. Generators 11 and 12 may include voltage amplifiers with high output impedance so that the generator which is switched off does not load the active generator.

I claim as my invention:

1. An x-ray diagnostic generator comprising:

an x-ray tube comprising a plurality of focal spots and a respective heating element for each of said focal spots;

a supply device comprising a single filament supply transformer including a primary winding and a secondary winding, a plurality of filament supply generators operable one at a time and each operable to generate a respective specific frequency and each assigned to a respective heating element, and a filament power adjustment circuit connected between said plurality of generators and said primary winding; and a plurality of band pass filters, each of said band pass filters having a pass band for passing only the specific frequency of a respective generator and each connected across said secondary winding and across the heating filament assigned to the respective generator, for selective energization of said heating filaments.

* * * * *